US005271241A

United States Patent [19]

Kim

[11] Patent Number: 5,271,241

[45] Date of Patent: Dec. 21, 1993

[54] DRAIN WATER EVAPORATING DEVICE FOR USE IN A REFRIGERATOR

[75] Inventor: Hyung K. Kim, Suwoon, Rep. of Korea

[73] Assignee: Samsung Electronics Co., Ltd., Suweon, Rep. of Korea

[21] Appl. No.: 916,682

[22] Filed: Jul. 22, 1992

[30] Foreign Application Priority Data

Aug. 21, 1991 [KR] Rep. of Korea ..... 191-12375[U]

[51] Int. Cl.[5] ..... F25B 47/00

[52] U.S. Cl. ..... 62/285; 62/277; 62/281

[58] Field of Search ..... 62/285, 272, 277, 279, 62/281, 288, 291

[56] References Cited

U.S. PATENT DOCUMENTS 2,267,486 12/1941 West ..... 62/272
4,272,969 6/1981 Shwitzgebel ..... 62/419
4,876,861 10/1989 Tanaka et al. ..... 62/279
4,979,377 12/1990 Fieuet et al. ..... 62/274

FOREIGN PATENT DOCUMENTS 0298563 1/1989 European Pat. Off. ..... 62/281
61-38069 11/1986 Japan .
1-169789 11/1989 Japan .

*Primary Examiner*—Albert J. Makay
*Assistant Examiner*—William C. Doerrler
*Attorney, Agent, or Firm*—Burns, Doane, Swecker & Mathis

[57] ABSTRACT

Drain water from a refrigerator flows to an evaporating plate located adjacent a compressor, so that heat from the compressor promotes the evaporation. A water spreader spreads the drain water as it reaches the evaporating plate to facilitate evaporation. Water which is not evaporated on the evaporating member gravitates to a container and is reabsorbed by the other evaporator member when the latter dries. The evaporator plate has ribs to efficiently use the heat received from the compressor.

7 Claims, 2 Drawing Sheets

DRAIN WATER EVAPORATING DEVICE FOR USE IN A REFRIGERATOR

FIELD OF THE INVENTION

The present invention is related to a device for removing drain water formed in a refrigerator, and more particularly to a device for evaporating draining water received through a drain passage by improving the use of the heat of a compressor to evaporate the drain water.

BACKGROUND OF THE INVENTION

An absorbing member of the prior art is disclosed in Japanese Utility Model Laid-Open No. 1-169789 (1989) and Publication No. 61-38069 (1986). The former discloses a refrigerator which comprises a supporting plate 11 having a drain water container 14, and a drain pipe 10 which conducts drain water to container 14. A compressor 6 is placed on the supporting plate 11. A U-shaped ceramic evaporating member 15 has a plurality of apertures 20, with each leg of the U shaped member positioned into the drain water container 14. The U shaped member 15 covers the compressor 6 to take advantage of the heat rising from the compressor. The latter prior art document discloses a refrigerator which comprises a machine storage portion with a compressor 14 installed in the machine storage portion, a water evaporating dish 20 positioned over the compressor 14 with a predetermined space L between the dish 20 and the compressor 14. The dish 20 is detachably mounted with mounting member 19 formed at an upper portion of the machine storage portion. A draining passage 17 is embedded in the wall 10 with a lower end opening thereof extending to the dish.

In both prior art disclosures, the lower end of the drain pipe 10,17 extends over the water evaporating dish 20 or the water container 14 for collecting the drain water. The collected water in the dish is evaporated by heat of the compressor. The collected water in the water contain 14 is absorbed by the evaporating member 15 to be evaporated by the heat of the compressor. If the container is small relative to the volume of drain water, the drain water overflows onto the floor, thereby creating a contamination problem. Further, a frequent cleaning is required.

Accordingly, it is an object of the present invention to provide a refrigerator drain water device which includes a water-spreading member to spread drain water directly to an evaporating member.

It is a further object of the present invention to provide a refrigerator drain water device which includes an evaporating member and no drain water dish to evaporate the down-flowing water therethrough.

It is a further object of the present invention to provide a refrigerator drain water device which enables the use of a smaller volume dish by the use of a water-reabsorbing evaporating member.

SUMMARY OF THE INVENTION

These and other objects of the present invention are achieved by providing a refrigerator drain water device which comprises a machine storage compartment housing a compressor therein. A water-spreading member is mounted on an upper portion of the machine storage compartment over the compressor. The water-spreading member includes a plurality of holes formed in the bottom thereof. An evaporating member extends downward in a slanted direction from between the water-spreading member and the compressor, for evaporating water received from the water-spreading member. A containing member receives the lower end of the evaporating member.

Further, the bottom portion of the spread member has a convex central configuration for evenly spreading the drain water along the downward slope of the evaporating member.

Furthermore, the evaporating member partially surrounds the compressor.

As a result of such structure, the drain water flows along a passage in the rear wall of the refrigerator. Drops of water are delivered directly to a central portion of the water-spreading member. The water then flows along the slope of the water-spreading member, and drains through a plurality of the holes to the evaporating member below. The water is then absorbed by the evaporating member and evaporates due to the heat generated by the compressor. The evaporating member also has a ribbed surface facing the compressor. The resulting concaveconvex shape of that surface increases the evaporation in the evaporating member while the absorbed water flows down through the evaporating member. The excess water which did not evaporate from the evaporating member, drains into and is stored in the containing member. The water in the containing member then is reabsorbed back into the evaporating member by capillary action as the evaporating member begins to dry. The reabsorbed water is completely evaporated by the heat of the compressor.

DESCRIPTION OF THE DRAWINGS

The present invention will now be described in detail with reference to the attached drawings, in which.

DESCRIPTION OF THE PREFERRED EMBODIMENT

Figure 1:
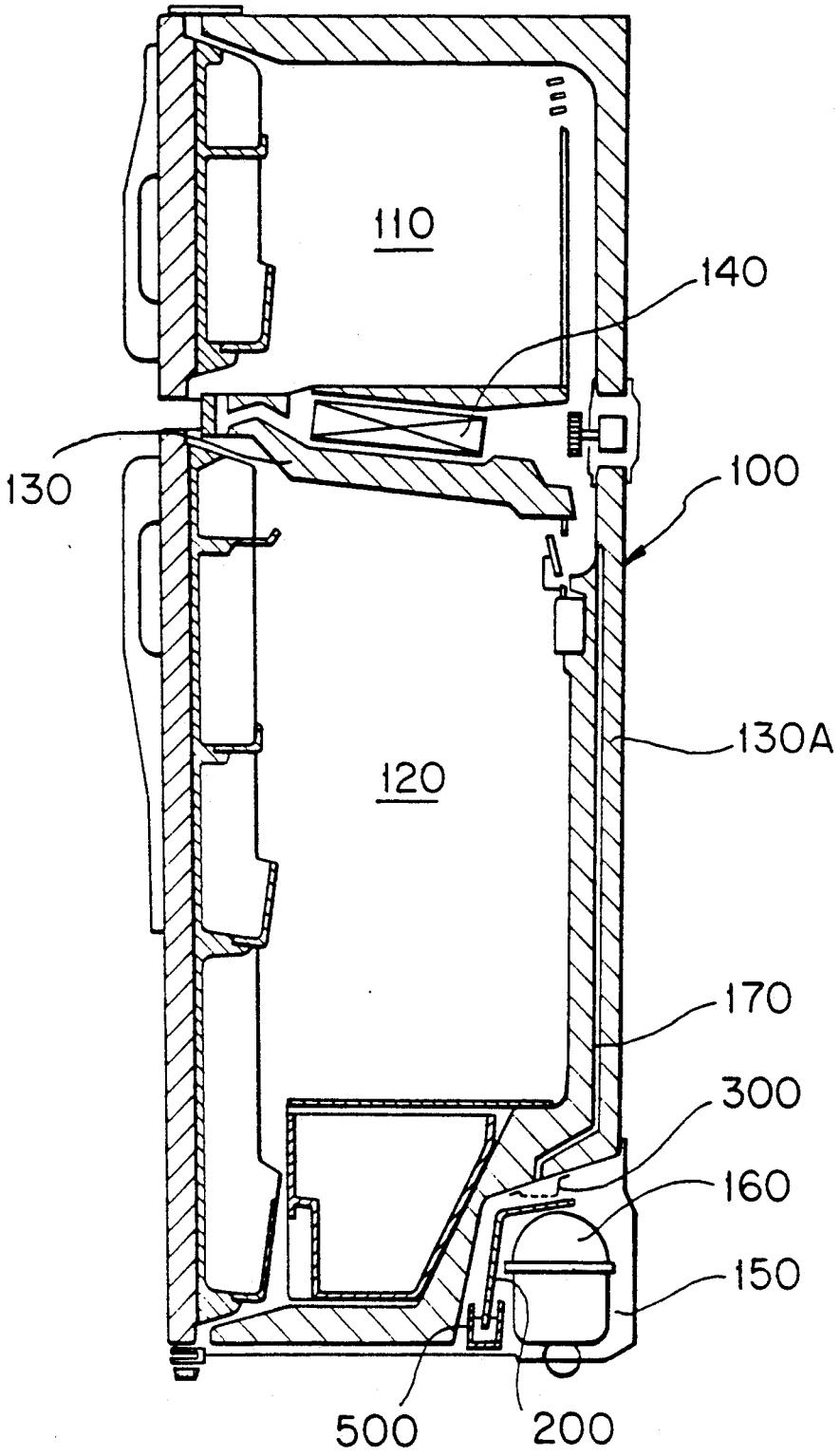
FIG. 1 is a vertical section view illustrating the drain water evaporating device of the present invention positioned in a refrigerator.

FIG. 1 illustrates a refrigerator 100 having a freezing compartment 110, a refrigerating compartment 120, and an evaporating compartment 110 which is partitioned by an intermediate wall 130 and is surrounded by an outer wall 130A.

In a rear wall of the outer wall 130 A a drain passage 170 extends from the rear bottom portion of the evaporating compartment 140 to an upper portion of the machine storage compartment 150. The machine storage compartment 150 houses a compressor 160 at the bottom rear portion thereof. Surrounding the lower opening of the drain passage 170 is a water-spreading member 300 which is mounted at the upper wall of the machine storage compartment 150. Between the water-spreading 300 and the compressor 160 an evaporating member 200 is positioned in a downward and slanted manner. The lower end of the evaporating member 200 is received into a containing member 500 which is located near the compressor 160.

Figure 2:
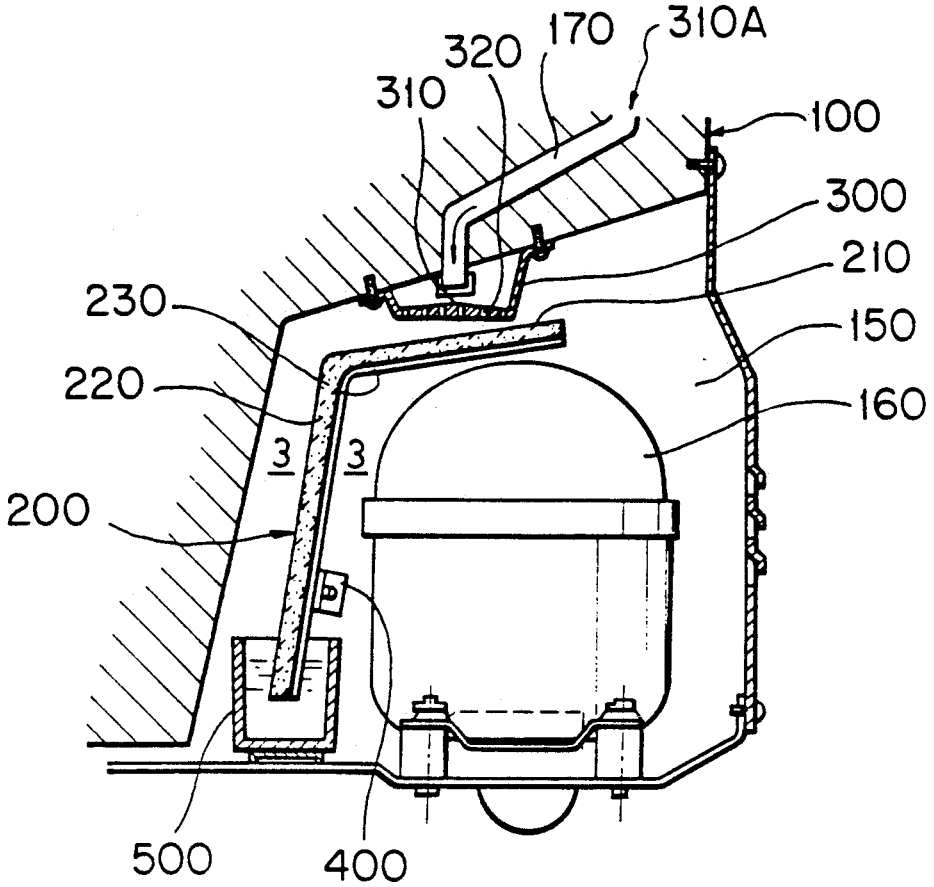
FIG. 2 is an enlarged vertical sectional view illustrating the drain water evaporating device.

FIG. 2 illustrates the lower opening of the drain passage 170 positioned in the ceiling of the machine storage compartment 150. The water-spreading member 300 has a bottom plate 310. The bottom plate 310 has a slanted structure in which the central area has a convex shape which extends radially to a peripheral rim of the water-spreading member 300. Further, in the bottom plate 310 a plurality of spread openings 320 are formed for spreading the water received from the drain passage 170 evenly onto the surface of the evaporating member 200.

The evaporating member 200 is made of a ceramic material which has a plurality of apertures formed therein. The evaporating member 200 comprises a generally horizontal portion 210 and a generally vertical portion 220 which are spaced along the outer configuration of the compressor 160. The evaporating member 200 may be mounted on either one side wall or both side walls of the machine storage compartment 150 by a bracket 100 or the like. The generally horizontal plate portion 210 is provided with a predetermined slant portion to effectively promote flow of the absorbed water in the generally horizontal portion 210 in a downward manner. Further, the generally horizontal portion 210 is located near the upper portion of the compressor 160. The slant of the generally horizontal portion 210 is provided to achieve effective evaporation by providing sufficient evaporating time by interfering in the flow of water in the evaporating member. In this embodiment, the preferred degree of slant is approximately 5 to 10 degrees. The generally vertical portion 220 of the evaporating member is joined integrally with an lower end of the generally horizontal portion 210. The generally vertical portion 220 extends downward and in a slanted manner. The lower end of the generally vertical portion 220 is received into the containing member 500. The containing member 500 is configurated to have sufficient volume to receive the lower end of the evaporating member 200. The containing member 500 collects water which is not evaporated as the drain water flows through the evaporating member 200. The collected water in the containing member 500 is reabsorbed by the lower end of the evaporating member 200 by capillary action of the evaporating member 500, and evaporates during upright movement through the evaporating member 200. In this embodiment, the evaporating member 200 is shaped in the character "L". However, other shapes may be used in accordance with the teachings, of the present invention.

Figure 3:
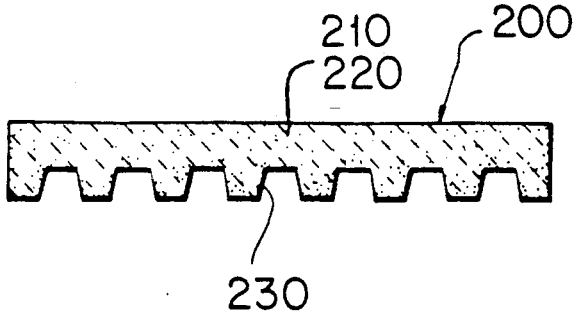
FIG. 3 is a cross sectional view of the evaporating member taken along line 3—3 of FIG. 2.

In FIG. 3, a plurality of protruding members 230 are formed on the inner plate of the evaporating member 200 in a longitudinal direction. The protruding member 230 increase the water evaporating efficiency by receiving more heat from the compressor 160.

According to the above structure, the drain water is spread directly to the evaporating member and is efficiently evaporated by the heat of the compressor. In view of the enhanced evaporation by the evaporating member, the containing member may not be necessary. The drain water evaporating device requires only a small volume in the refrigerator. Any water which flows into the containing member is completely evaporated, and this leads to better sanitary conditions in the machine storage compartment.

What is claimed is:

1. In a refrigerator having a compressor, an evaporating compartment in which drain water is generated, a drain passage for conducting the drain water, and evaporation means for receiving and evaporating the drain water, said evaporation means comprising:

an evaporating member positioned to receive and conduct the drain water, the evaporating member positioned adjacent the compressor to receive heat therefrom, said evaporating member having a surface facing said compressor, said surface including a concave-convex undulating profile forming heat-exchange ribs, and a water-spreading member positioned upstream of said evaporating member and configured to spread-out water received from said evaporating compartment and direct the spread-out water to said evaporating member, said water-spreading member including a plate disposed over said evaporating member, said plate including an upper surface arranged under said drain passage to receive drain water to receive drain water therefrom.

2. Apparatus according to claim 6, wherein said upper surface is of generally convex shape.

3. Apparatus according to claim 6, wherein said plate includes apertures spaced inwardly from an outer periphery of said plate.

4. Apparatus according to claim 1 including a container disposed at a lower end of said evaporating member for receiving drain water therefrom, said evaporating member formed of a material for reabsorbing residual drain water from said container by capillary action once said evaporating member has dried.

5. Apparatus according to claim 1, wherein said evaporating member includes a generally horizontal plate portion and a generally vertical portion, said generally horizontal portion being positioned beneath said water-spreading member and over said compressor, said generally horizontal portion being slightly including, said generally vertical portion being joined to a lower edge of said generally horizontal member.

6. Apparatus according to claim 5 including a container arranged beneath a lower end of said generally vertical portion for receiving drain water therefrom.

7. Apparatus according to claim 6, wherein said generally vertical portion is slightly inclined.

* * * * *